US006835092B2

(12) United States Patent
Wan et al.

(10) Patent No.: US 6,835,092 B2
(45) Date of Patent: Dec. 28, 2004

(54) STACKED ELECTRICAL CONNECTOR ASSEMBLY WITH ENHANCED GROUNDING ARRANGEMENT

(75) Inventors: Qing Wan, Kunsan (CN); Qisheng Zheng, Kunsan (CN); DaKun Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/627,786

(22) Filed: Jul. 25, 2003

(65) Prior Publication Data

US 2004/0224558 A1 Nov. 11, 2004

(30) Foreign Application Priority Data

May 9, 2003 (TW) ..... 92208555 U

(51) Int. Cl.[7] ..... H01R 13/60
(52) U.S. Cl. ..... 439/541.5; 439/607
(58) Field of Search ..... 439/541.5, 489–490, 439/676, 607–610, 571–573, 701

(56) References Cited

U.S. PATENT DOCUMENTS 6,162,089 A 12/2000 Costello et al.
6,174,198 B1 * 1/2001 Wu et al. ..... 439/541.5
6,183,292 B1 * 2/2001 Chen et al. ..... 439/541.5
6,247,970 B1 * 6/2001 Ueno et al. ..... 439/608
6,319,051 B1 * 11/2001 Chang et al. ..... 439/490
6,520,799 B1 2/2003 Cheng et al.
6,540,563 B1 * 4/2003 Hu et al. ..... 439/676
6,682,365 B1 * 1/2004 Walker et al. ..... 439/488

* cited by examiner

*Primary Examiner*—Gary Paumen
*Assistant Examiner*—Edwin A. Leon
(74) *Attorney, Agent, or Firm*—Wei Te Chung

(57) ABSTRACT

A stacked electrical connector assembly (100) mounted on a main printed circuit board (PCB not shown) includes an insulative housing (1) defining at least two cavities (101, 111), a first and second array of conductive contacts (42, 2) received in the housing, a ground plate (3) disposed between the first and the second contacts, an internal PCB (41) arranged in a rear portion of the housing and an outer shell (5) substantially surrounding the insulative housing. The internal PCB includes a ground trace and a number of signal traces in a galvanic connection with the first array contacts. The ground plate includes a grounding claw (32) electrical connection with the outer shell and a grounding leg (31) coupling to the ground trace of the internal PCB.

16 Claims, 7 Drawing Sheets

STACKED ELECTRICAL CONNECTOR ASSEMBLY WITH ENHANCED GROUNDING ARRANGEMENT

BACKGROUND OF THE INVENTION

1. Field of the Invention

The present invention relates to electrical connectors and more particularly, to a stacked LAN connector assembly mounted to an apparatus such as a notebook type personal computer, a game machine or the like and mated with a modular plug corresponding thereto.

2. Description of the Prior Art

Modular jack receptacle connectors and Universal Serial Bus (USB) connectors are commonly used the computers or network appliance as input/output ports for transmitting data or signals. An example of such a connector is disclosed in U.S. Pat. No. 6,162,089 issued to Costello et al. on Dec. 19, 2000 which describes a stacked LAN connector. The Costello connector includes a stacked USB component and a modular jack component secured in respective portions of main housing, an outer shield around the main housing and an inner shield surrounding the stacked USB component. The inner shield includes a front shield having a plurality of grounding legs and a rear shield attached to the front shield.

However, high frequency transmission requires EMI shielding and crosstalk protection be formed between modular jack and USB connectors in order to improve quality of transmission. Moreover, the structure of the Costello connector is obviously complicated and the cost of the connector is thus relatively high. Furthermore, the inner shield is relatively large for forming the grounding legs in addition when used in stacked modular jack application and the assemble process is complicated. The mounting process and ground connection become more complicated when more ports are integrally made as an assembly.

Hence, an improved electrical connector incorporating electrical connectors of different types and providing good signal transmitting quality is desired to overcome the foregoing shortcomings.

BRIEF SUMMARY OF THE INVENTION

A main object of the present invention is to provide a stacked connector assembly with reliably EMI shielding.

Another object of the present invention is to provide a stacked connector assembly having a ground plate for simplifying the manufacture and reducing cost.

A stacked electrical connector assembly mounted on a main printed circuit board (PCB) includes an insulative housing defining at least two cavities, a first and second array of conductive contacts received in the housing, a ground plate disposed between the first and the second contacts, an internal PCB arranged in a rear portion of the housing and an outer shell substantially surrounding the insulative housing. The internal PCB includes a ground trace and a number of signal traces in a galvanic connection with the first array contacts. The ground plate includes a grounding claw electrical connection with the outer shell and a grounding leg coupling to the ground trace of the internal PCB.

Other objects, advantages and novel features of the invention will become more apparent from the following detailed description when taken in conjunction with the accompanying drawings.

DETAILED DESCRIPTION OF THE INVENTION

Figure 1:
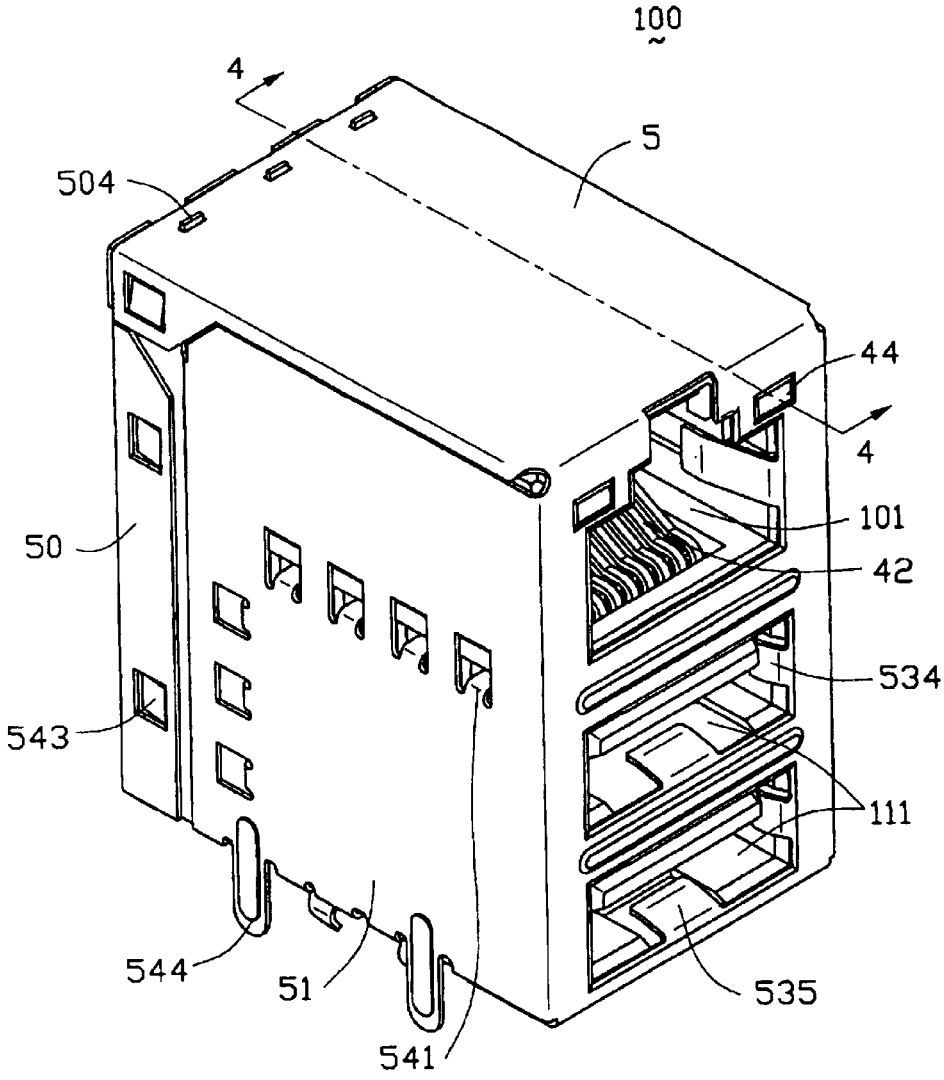
FIG. 1 is a perspective view of a stacked connector assembly according to the present invention.
Figure 2:
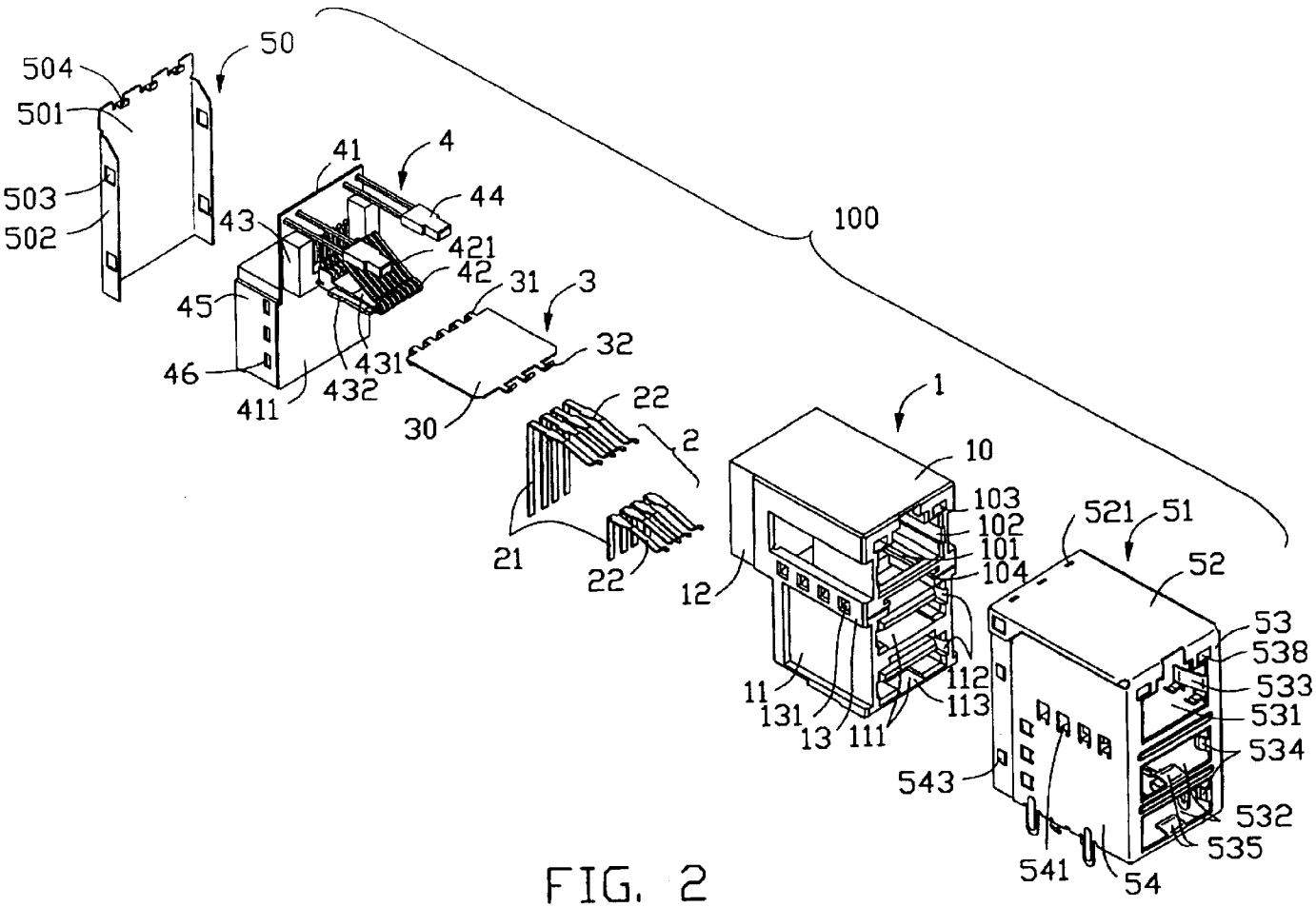
FIG. 2 is an exploded view of FIG. 1.
Figure 3:
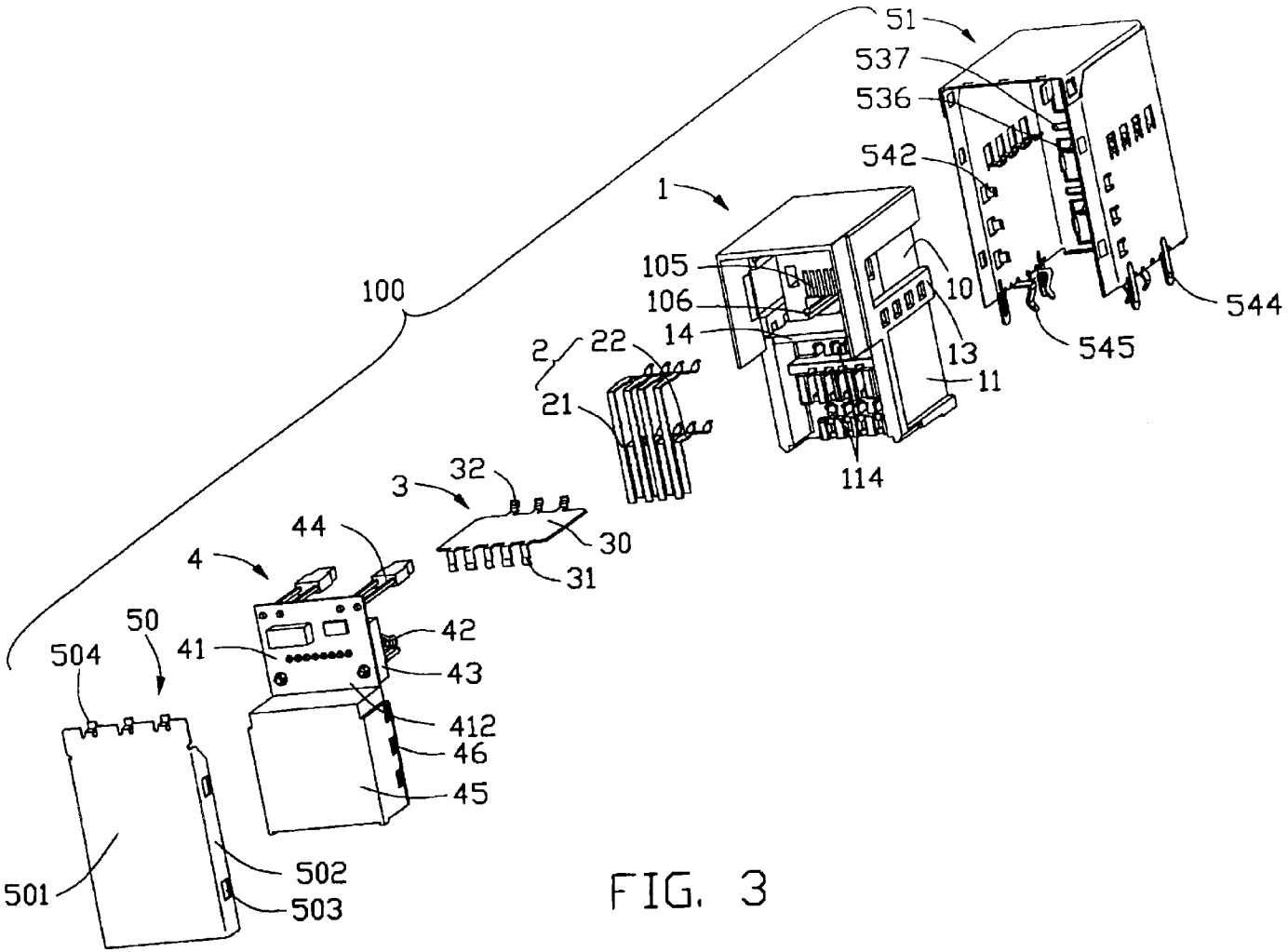
FIG. 3 is another exploded view of FIG. 1.
Figure 4:
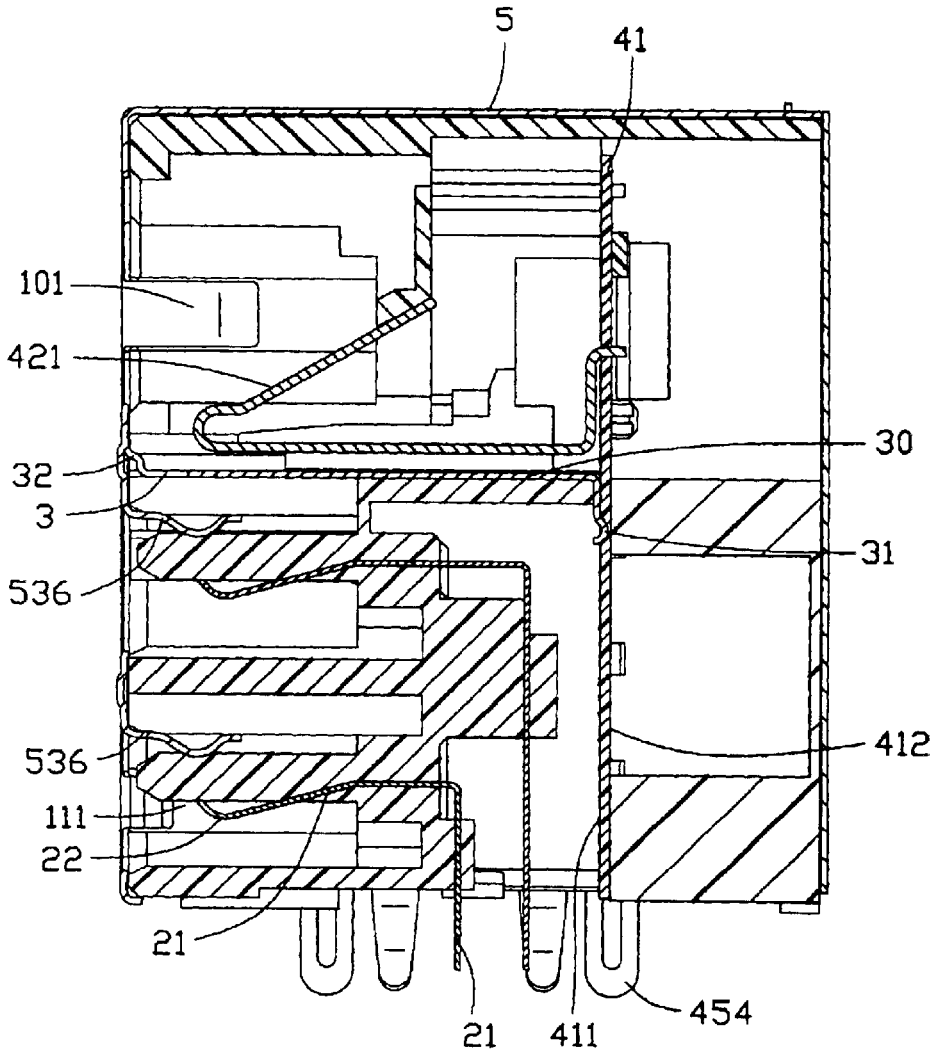
FIG. 4 is a cross-sectional view of the stacked connector assembly taken along line 4—4 of FIG. 1.
Figure 5:
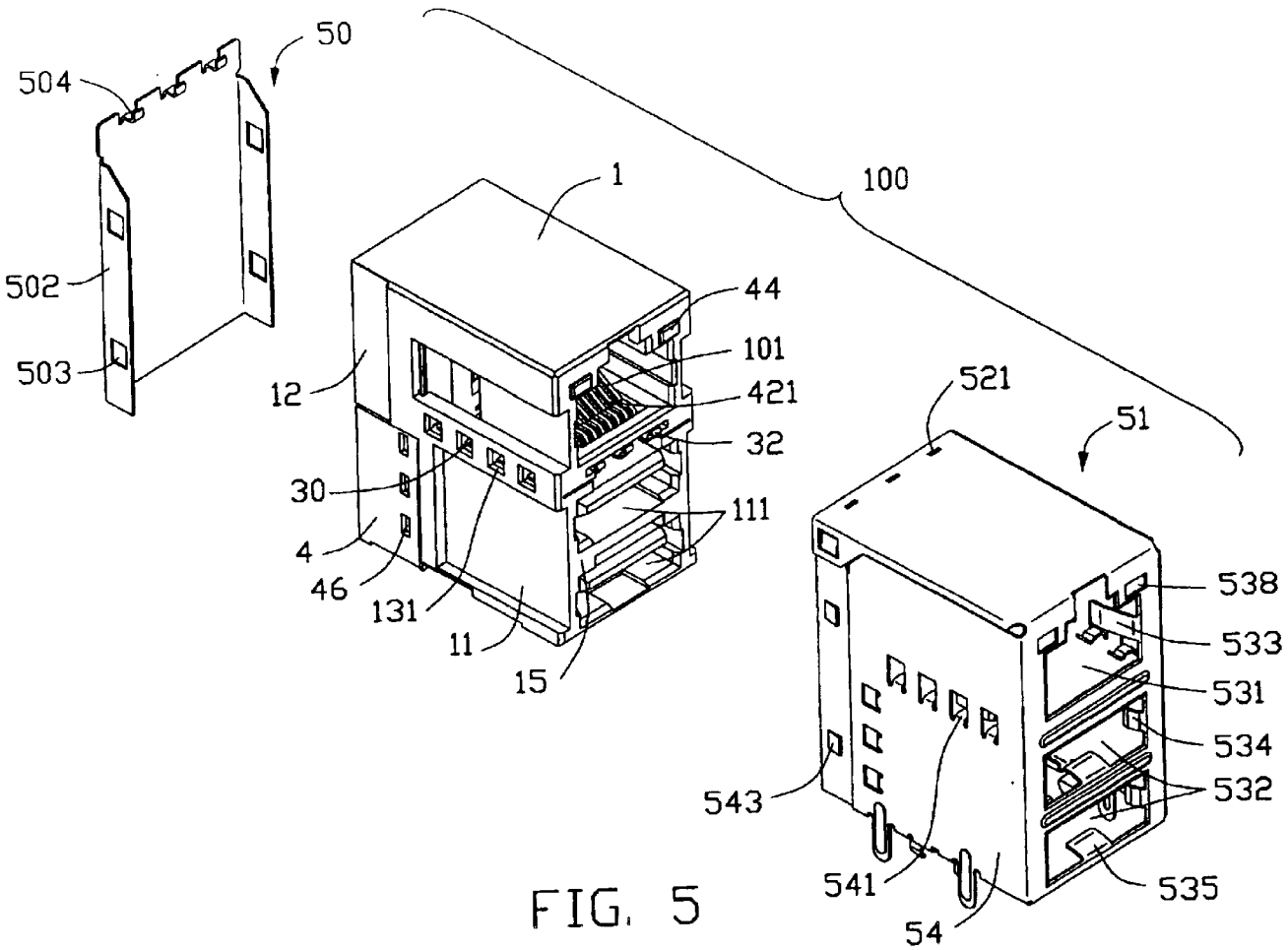
FIG. 5 is a partially assembled view of FIG. 2, wherein a plurality of contacts, a ground plate and an insert module are assembled within an insulative
Figure 6:
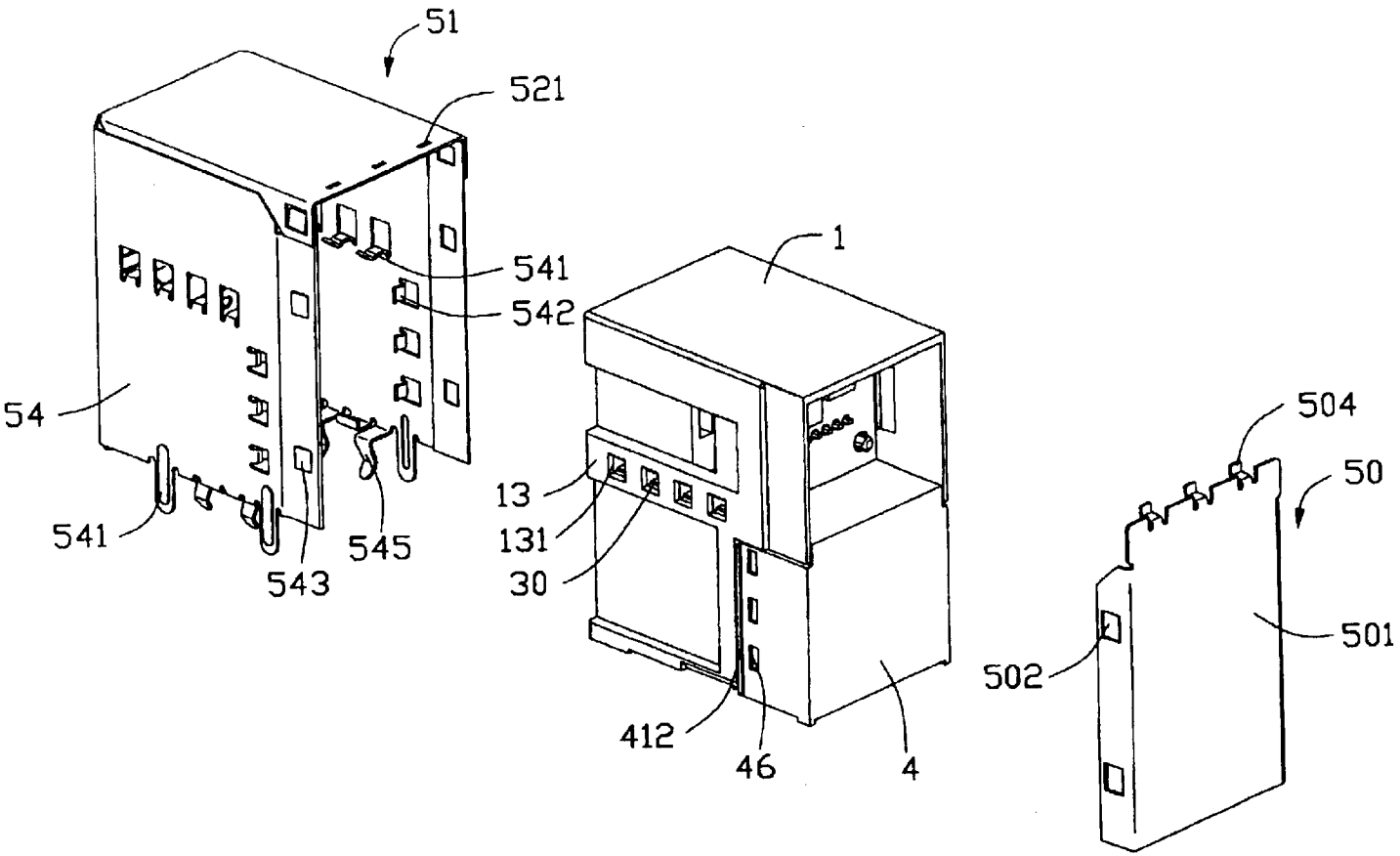
FIG. 6 is a partially assembled view of FIG. 3, wherein a plurality of contacts, a ground plate and an insert module are assembled within an insulative housing.
Figure 7:
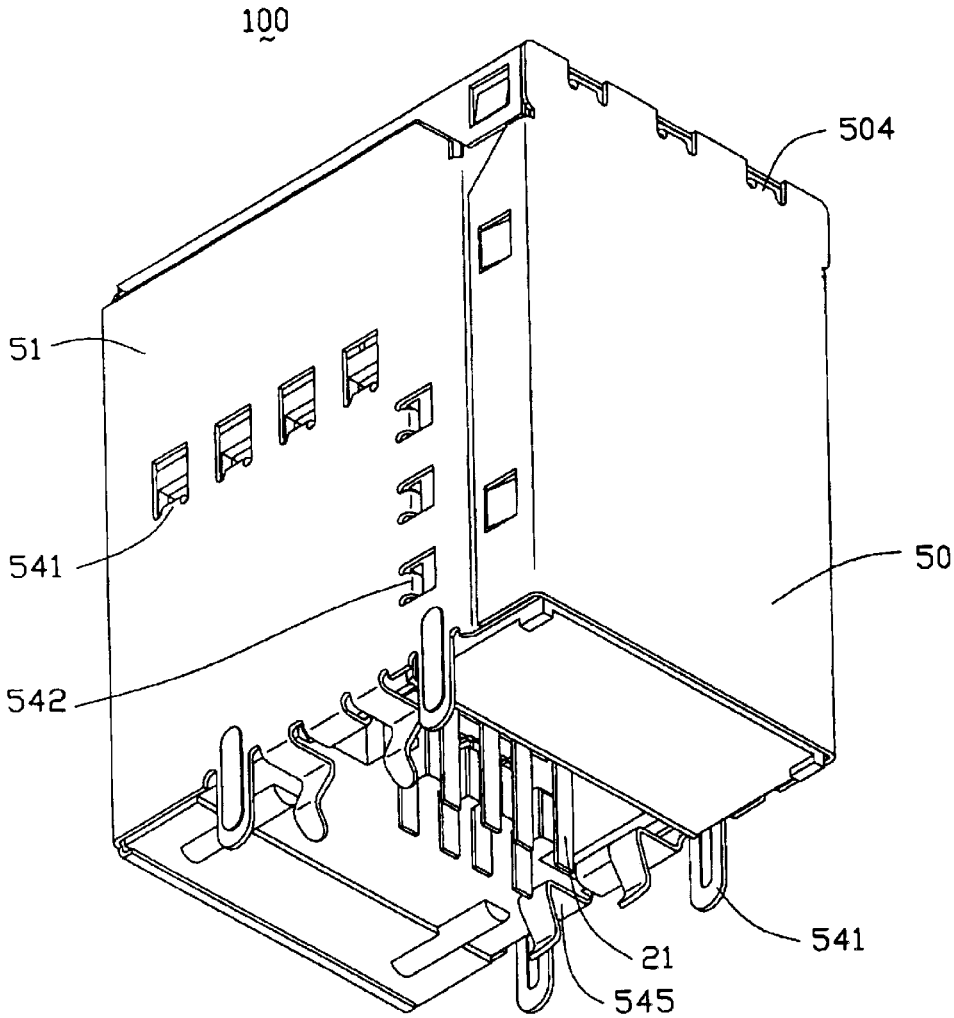
FIG. 7 is another assembled view of FIG. 6 taken from a bottom aspect.

Referring to FIGS. 1, 2 and 3, a stacked connector assembly 100 of the present invention mounted on a main printed circuit board (PCB, not shown) has a mating face (not labeled) provided with a first plug-receiving cavity and a second plug-receiving cavity stacked over the first plug-receiving cavity. In the embodiment illustrated, the first plug-receiving cavity includes two USB plug-receiving cavities 111 for receiving USB type connectors, while the second plug-receiving cavity is a modular plug-receiving cavity 101 for receiving an RJ type connector. However, it is noted that the present invention can be applied to connectors other than these type. The stacked connector 100 includes an insulative housing 1, a plurality of USB contacts 2 received in the housing 1, a ground plate 3, an insert modules 4 and an outer shell 5 substantially surrounding and shielding the housing 1.

The housing 1 includes a front face 15, an upper section 10 shared a panel 14 with a lower section 11, and an extending section 12 extending rearwardly from the upper section 10 thereby providing a space (not labeled) for partially receiving the insert module 4.

The modular plug-receiving cavity 101 is defined in the upper section 10 for receiving the modular plug type connector (not shown) thereinto, a plurality of passages 105 extending forwardly in communication with the modular plug-receiving cavity 101 and a pair of apertures 103 besides the modular plug-receiving cavity 101. The modular plug-receiving cavity 101 defines a pair of recesses 102 on opposite sides thereof. A pair of guiding slots 106 is defined on opposite sides of the passage 105 for guiding the insert module 4. The upper section 10 defines a slot 104 extending forwardly throughout the housing 1 between the passage 105 and the panel 14. The upper section 10 further includes two sidewalls 13 each having a plurality of through holes 131 extending inwardly therethrough and communicating with the slot 104.

Said two stacked USB plug-receiving cavities 111 is defined in the lower section 11 and extends rearwardly thereinto from the front face 15 for receiving the USB type connectors (not shown) therein. Each USB plug-receiving cavity 111 defines a pair of first grooves 112 on opposite side thereof and a second groove 113 on the bottom face thereof. The lower section 11 further defines a plurality of passageways 114 extending forwardly in communicating with the corresponding USB plug-receiving cavities 111 for receiving the USB contacts 2 therein.

Each USB contact 2 includes a vertical portion 21 and a contact portion 22 extending form an upper portion of the vertical portion 21.

The ground plate 3 is stamped from one metal sheet and includes a planar body 30, a plurality of grounding legs 31 extending downwardly from one side of the planar body 30 and a plurality of grounding claws 32 extending upwardly from opposite side of the planar body 30.

The insert module 4 includes an internal PCB 41 having a first and second faces 411, 412, a plurality of conductive terminals 42 soldered on the internal PCB 41, an unitarily molded insulator 43 receiving the terminals therein and stabilized on the first face 411 of the internal PCB 41, a pair of LEDs (light-emitting devices) 44 attached to the first face 411 of the internal PCB 41 for visual indication and signal conditioning components 45, such as a magnetic module, arranged on the second face 412 of the internal PCB 41 for reducing or eliminating noise. A plurality of cutouts 46 are defined on the conditioning component 45. The insulator 43 includes a horizontal base 431 having a pair of guiding rails 432 on opposite sides. Each terminal 42 includes a retention portion (not shown) secured within the base 431 and a mating portion 421 extending upwardly and being angled inwardly toward the base 431. It should be noted that the signal conditioning components 45 electrically connect with the terminals 42 through traces (not shown) of the internal PCB 41 for signal conditioning.

The outer shell 5 is stamped from a sheet of conductive material and includes a front shell 51 and a rear shell 50 attached to the front shell 51. The rear shell 50 includes a rear plate 501 and a pair of flaps 502 extending forwardly from opposite sides of the rear plate 501 each having a number of locking holes 503 therein. The rear plate 501 has a plurality of barbs 504 projecting forwardly from a top end thereof and generally perpendicular thereto.

The front shell 51 includes an upper plate 52, a front plate 53 and two side plates 54. The upper plate 52 defines a plurality of locking slots 521 on an rear portion thereof for engaging with the locking holes 503. The front plate 53 defines a modular plug-opening 531 and two USB plug-openings 532 corresponding to the modular and USB plug-receiving cavities 101, 111 of the housing 1 respectively, and also a pair of LED-receiving holes 538. The front plate 53 includes a pair of spring arms 533 extending inwardly along opposite sides of the modular plug-opening 531 for interference fitting with the recesses 102. Further, the front plate 53 includes engaging fingers 534, 535, 536 extending inwardly around each USB plug-opening 532 that provide for insertion of the USB type connectors. A depression 537 is defined in an inner face of the front plate 53 between the modular and USB plug-openings 531, 532 for receiving the grounding claws 32 of the ground plate 3. Each side plate 54 includes a plurality of first or horizontal tabs 541 extending inwardly that arranged in a horizontal row and a plurality of second or vertical tabs 542 projecting inwardly that arranged in a vertical row below the first or horizontal tabs 541. Each side plate 54 forms a number of embossments 543 on a rear portion thereof for engaging with respective one of the locking holes 503, a plurality of grounding tail 544 extending downwardly therefrom and a plurality of retention tabs 545 for securely capturing the housing 1.

In assembly, as shown in FIGS. 3 through 7, the USB contacts 2 are installed into respective one of the passageways 114 with contact portions 22 being exposed in the USB plug-receiving cavities 111 for electrically connecting with contacts of the USB type connectors (not shown). The ground plate 3 is held in the slot 104 by the grounding claws 32 extending along the panel 14 and abutting against the front face 15 of the housing 1. The insert module 4 is assembled to the housing 1 thereafter. The LEDs 44 extend forwardly through the respective apertures 103 and beyond the front face 15 of the housing 1. The guiding rails 432 of the insulator 43 are inserted into the extending section 12 of the housing 1 and into guiding slots 106 along side surfaces thereof with the mating portions 421 of the terminals 42 being exposed in the modular plug-receiving cavity 101 for being mated. The grounding legs 31 of the ground plate 3 abut against the first face 411 of the internal PCB 41 and in electrical connection with the grounding trace (not shown) thereof.

The rear shell 50 is attached to the front shell 51 after the front shell 51 substantially surrounds the housing 1. The front shell 51 envelops the housing with the front plate 53 along the front face 15, and the modular and USB plug-openings 531, 532 are appropriately apertured to expose the modular and USB plug-receiving cavities 101, 111, as such the LEDs 44 extend forwardly through the LED-receiving holes 538. The grounding claws 32 bear against the depression 537. The spring arms 533 extend inwardly and interferentially fit with the recesses 102. The engage fingers 534, 535 engage with the respective first and second grooves 112, 113. The first or horizontal tabs 541 of the side plates 54 extend through respective one of the through holes 131 of the sidewalls 13 and securely abut against the planar body 30, while the second or vertical tabs 542 extend through the corresponding cutouts 46 and bear against the second face 412 and electrically connect with the grounding trace (not shown) of the internal PCB 41. The retention tabs 545 are attached to a bottom wall (not labeled) of the housing 1 for securely capturing the housing 1. The rear shell 50 is assembled to the front shell 51 with the embossments 543 received in the locking holes 503 and the barbs 504 engaged with the locking slots 521. The stacked connector assembly 100 may then be shielded in every routeway and formed an integral ground plane system that establishes the signal integrity characteristic of the connector assembly, whereby EMI from outer environment and crosstalk between the high-speed signals of the terminals and contacts of the stacked connector assembly can be eliminated rapidly and efficiently.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an insulative housing defining at least two cavities;

a first and second array of conductive contacts received in the housing, each of the first and the second contacts partially extending into a corresponding cavity;

a ground plate disposed between the first and the second contacts;

a printed circuit board arranged in a rear portion of the housing, the printed circuit board having a plurality of signal traces and a ground trace, at least one array of contacts electrically connecting with the signal traces, the ground plate coupling to the ground trace; and an outer shell substantially surrounding the insulative housing, the outer shell having a plurality of first tabs on opposite sides thereof mechanically and electrically engaging with the ground plate.

2. The electrical connector assembly according to claim 1, wherein the housing defines a plurality of holes on opposite sides, and the first tabs extend through respective one of the holes and electrically contact with the ground plate.

3. The electrical connector assembly according to claim 1, wherein the ground plate has a grounding leg extending downwardly from other end thereof, the grounding leg electrically connecting with the grounding trace.

4. The electrical connector assembly according to claim 1, further including a pair of Light Emitting Diodes (LEDs) attached to the printed circuit board for visual indication and signal conditioning components arranged on the printed circuit board for reducing or eliminating noise.

5. The electrical connector assembly according to claim 1, wherein the housing defines a slot between the two cavities for receiving the ground plate therein.

6. The electrical connector assembly according to claim 5, wherein the ground plate has a grounding claw extending upwardly form one end thereof, the grounding claw extending beyond the housing for electrically connecting with the outer shell.

7. The electrical connector assembly according to claim 1, wherein the outer shell includes a front shell and a rear shell, the front shell including an upper plate defining a plurality of locking slots therein and two side plates each having a plurality of embossments, the rear shell including a plurality of locking holes locking over embossments of side plates and a plurality of barbs engaging with locking slots of the upper plate.

8. The electrical connector assembly according to claim 7, wherein the front shell defines a depression therein, and wherein the grounding plate has a grounding claw bearing against the depression.

9. The electrical connector assembly according to claim 1, wherein the outer shell has a plurality of second tabs for connecting with the grounding traces of the printed circuit board.

10. The electrical connector assembly according to claim 9, wherein the second tabs are arranged in a vertical row and the first tabs are arranged in a horizontal row.

11. An electrical connector comprising:

an insulative housing defining divided first and second cavities;

a plurality of first contacts and a plurality of second contacts respectively located in said two cavities, respectively;

a ground plate located between and separating said first and second cavities;

a front shield covering at least a front face of the housing and defining two opening to expose said first and second cavities to an exterior in a front-to-back direction; and a printed circuit board disposed behind and perpendicular to the grounding plate;

wherein said grounding plate includes a front section mechanically and electrically engaging a middle portion of the front shield which is located between the two openings, and a rear section mechanically and electrically engaging the printed circuit board.

12. The connector according to claim 11, wherein said housing includes a plurality of through holes to allow said tabs to extend therethrough.

13. The connector according to claim 11, further including two side shells with inwardly extending tabs engaged with either the ground plate or the printed circuit board.

14. The connector according to claim 13, wherein said two sides shells are integrally formed with the front shield.

15. An electrical connector comprising:

an insulative housing defining divided first and second cavities;

a plurality of first contacts and a plurality of second contacts respectively located in said two cavities, respectively;

a ground plate located between and separating said first and second cavities;

an outer shell at least partially covering the housing; and a printed circuit board disposed behind and perpendicular to the grounding plate; wherein said grounding plate includes legs mechanically and electrically engaging the printed circuit board, and said outer shell includes tabs mechanically and electrically engaging the printed circuit board.

16. The connector according to claim 15, wherein said outer shell further includes other tabs engaging the ground plate.

* * * * *